US005873372A

United States Patent [19]

Honeycutt et al.

[11] Patent Number: 5,873,372

[45] Date of Patent: Feb. 23, 1999

[54] PROCESS FOR STEAM EXPLOSION OF TOBACCO STEM

[75] Inventors: Rufus H. Honeycutt, Kathlene, Ga.; Elliott S. Sadle, Louisville, Ky.; Elmer F. Litzinger, Macon, Ga.; Dennis M. Boyle, Marthsville, Mo.

[73] Assignee: Brown & Williamson Tobacco Corporation, Louisville, Ky.

[21] Appl. No.: 854,648

[22] Filed: May 12, 1997

Related U.S. Application Data

[63] Continuation of Ser. No. 510,236, Aug. 2, 1995, abandoned.

[51] Int. Cl.[6] ..... A24B 15/28

[52] U.S. Cl. ..... 131/309; 131/310

[58] Field of Search ..... 131/300, 303, 131/276, 309, 310, 301, 302

[56] References Cited

U.S. PATENT DOCUMENTS

| | | | |
|---|---|---|---|
| 42,319 | 1/1864 | Storer . | |
| 2,032,437 | 3/1936 | Richter . | |
| 2,454,534 | 1/1948 | Walter . | |
| 2,516,384 | 1/1950 | Hill et al. . | |
| 2,711,369 | 1/1955 | Birdseye . | |
| 2,964,518 | 1/1960 | Snyder . | |
| 3,308,013 | 3/1967 | Bryant . | |
| 3,533,906 | 10/1970 | Reiniger . | |
| 3,970,091 | 7/1976 | Banks et al. . | |
| 4,607,646 | 8/1986 | Lilly, Jr. et al. . | |
| 4,677,994 | 7/1987 | Denier et al. . | |
| 4,687,007 | 8/1987 | Denier et al. | 131/302 |
| 4,825,884 | 5/1989 | Denier et al. . | |
| 4,827,949 | 5/1989 | Sunas . | |
| 4,962,774 | 10/1990 | Thomasson et al. . | |

*Primary Examiner*—Mark O. Polutta
*Assistant Examiner*—Charles W. Anderson
*Attorney, Agent, or Firm*—Middleton & Reutlinger; John F. Salazar; Charles I. Sherman

[57] ABSTRACT

This invention relates to a process of exploding tobacco stems to improve smoke quality, and more particularly to a process of exploding the cells of tobacco stems with high pressure saturated steam, followed by rapid depressurization and quenching, in order to reduce negative contributors to smoke quality and to form favorable flavor compounds.

10 Claims, 1 Drawing Sheet

PROCESS FOR STEAM EXPLOSION OF TOBACCO STEM

This application is a continuation of Ser. No. 08/510,236 filed Aug. 2, 1995, abandoned.

BACKGROUND OF THE INVENTION

It has been generally known for years that treating fibrous vegetable substances with pressurized steam will contribute to the breakdown of the fibers. In addition, steam treatment has been used in conjunction with chemical additives, usually some form of ammonia and alkaline materials, to also modify tobacco properties. For example, one long expired patent, U.S. Pat. No. 42,319 to Jacob S. Storer (1864), teaches treating the fibrous part of plants (such as, straw, grasses, leaves, or stems of plants having long staple or woody fibers) with chemicals (such as, potash, soda, soda ash, ammonia, lime or salts) and by mediation of steam, dissolve out undesirable compounds that would impair the material's quality or color. U.S. Pat. No. 2,032,437 to Richter (1936) teaches a process whereby fiber is liberated from wood or other raw cellulosic material by the chemical action of a digester liquid, such as a sulfite or acid sulfite cooking liquor, while under confinement. U.S. Pat. No. 2,964,518 to Snyder (1960) teaches a process in which woody materials are subjected to the action of ammonia and steam at pressures in the range of 600 to 1250 PSIG and temperatures of about 250° to 300° C. for up to 90 minutes to separate the fibrous and ligneous portions of the material.

It is also generally known in the tobacco processing art to use steam and chemicals as a means for forming flavor compounds in tobacco. U.S. Pat. No. 4,607,646 to Lilly, Jr., et al. (1986) teaches reacting ammonia with non-burley tobacco containing natural sugars, in a pressure controlled system heated to temperatures of 80° to 150° C. in order to impart burley-like smoke flavor characteristics, yet retain substantially all volatile tobacco components. Several other patents are known that relate to processes for treating tobacco to form flavor compounds. U.S. Pat. No. 4,677,994 to Denier et al. (1987) teaches treating, drying and expanding tobacco by applying an ammonia source to the tobacco, then treating the ammoniated tobacco with steam for a preselected time, with the result being improved flavor quality and fill value of the tobacco. U.S. Pat. No. 4,744,375 to Denier et al. (1988) teaches introducing moistened tobacco into a containing zone, introducing an ammonia source, and heating the contained zone to bring the tobacco to a preselected temperature to produce flavor compounds in the tobacco. U.S. Pat. No. 4,825,884 to Denier et al. (1989) teaches contacting the tobacco with citrus pectin, invert sugar, or diammonium phosphate, or a combination thereof, introducing the moistened tobacco into a containing zone along with an ammonium source, and heating the containing zone to bring the tobacco to a preselected temperature to produce flavor compounds in the tobacco.

In the main, the past tobacco treating art has utilized various combinations of steam, ammonia or chemicals in treating tobacco materials in order to form flavor compounds or to break down the lignin and cellulose in wood products to form by-products useful in manufacturing other goods.

SUMMARY OF THE INVENTION

In the present invention, an improved, straightforward, efficient and economical tobacco treating process is provided. The present invention recognizes the benefits, efficiency, economy and utility of treating tobacco stems, both burley and flue-cured, in a high pressure saturated steam atmosphere for a short period of time, then suddenly releasing the pressure, thereby causing the cells of the tobacco stem fibers to explode. This yields a tobacco stem product having improved smoke properties. Additionally, steam explosion of tobacco stems may be supplemented by pre-treating the tobacco stems with chemicals, such as ammonia or other alkaline compounds, although such chemical treatment is not required to modify smoke qualities or produce flavor compounds of the tobacco stems.

Steam explosion of tobacco stems is a means of fragmenting biopolymers that can be negative contributors to the smoke quality of the stems when burning. High pressure steam is used to penetrate the cell walls of plants, where at a high temperature, the steam reacts with and fragments biopolymers contained in the cells. Several of these biopolymers are suspected of being negative contributors to smoke quality. Reducing these negative contributors has been found to improve sensory characteristics of the tobacco, such as more body, better taste and less irritation. In addition, some steam exploded stem fragmentation by-products may improve smoke quality. Further, the addition of chemical additives to the tobacco stems prior to steam explosion can enhance the steam explosion process. Chemical additives include organic acids to catalyze hydrolysis, ammonia to react with sugars, and potassium carbonate to catalyze the production of flavor compounds from lignin. This invention provides a process that is especially useful because the principal reactant, water, in steam formation is relatively inexpensive and non-toxic.

In particular, the present invention provides a unique process for improving smoke quality of tobacco stems by introducing the tobacco stems, burley or flue-cured, into a tobacco containing zone, heating the contained zone when closed to bring the stems to a temperature in the range of 193° to 231° C. at high pressure (200–400 psig) for a sufficient period of time (about 1 to 8 minutes), followed by the sudden and rapid decompression of the pressurized steam in the tobacco containing zone and the quenching of the tobacco stems so as to cause the plant cells to explode thereby modifying the lignocellulose in the fibers of tobacco stems and, in turn, reducing negative contributors to the sensory properties of smoke while producing improved tobacco flavor compounds. The resulting materials, depending on different time and pressure conditions, vary from fibrous separation to gelatinous form and are more aromatic than unexploded raw stems. The aromas are generally described as chocolate, vanilla, licorice, prune, pumpkin, wine, bread, toast, and coffee. Additionally, subsequent laboratory analyses have found substantial changes in the chemical make-up of the tobacco stems following steam explosion, namely the exploded stems appear to have elevated levels of furan derivatives, carboxylic acids, alcohols and phenolics. Further steam explosion of flue-cured stems has been found to generate additional sugars and contain other water soluble lignin decomposition products.

In addition to the steam explosion of tobacco stems, chemical additives may be applied to the tobacco stems prior to impregnation with steam to catalyze the production of favorable flavor compounds. In particular, ammonia in the form of diammonium phosphate has been found to be beneficial, especially for flue-cured stems. Organic acids, such as lactic acid, have been found to improve burley stems, while citric and lactic acids have been found to catalyze the breakdown of biopolymers, resulting in observations of decreased smoke inhalation irritation. Potassium carbonate has been found to catalyze the formation of vanillin-type flavor compounds, although salts of other weak acids and strong bases may also be used. Further, alkaline ammonia sources, such as ammonium bicarbonate, and urea, have been found to create sensory properties similar to that of diammonium phosphate, and may also soften the cellulose. Even further, acidic ammonia in the form of diammonium citrate, has been found to catalyze the hydrolysis of the hemicellulose into sugars, which subsequently react with the ammonia to form desirable sugar-ammonia compounds, although other ammonia compounds with appropriate pH levels may be used.

Typically, steam exploded stem by-products are used to make thin paper sheets, called hand sheets, which are cut into strips and mixed with tobacco to make reconstituted tobacco product. Hand sheets made from steam exploded stems have superior physical properties, such as toughness, strength, elongation, and stiffness, compared to presently commercially available reconstituted tobacco. It is believed that adding lactic acid to burley stems and adding diammonium phosphate to flue-cured stems prior to steam explosion may be helpful in producing the desirable sensory effects in the tobacco stems and in the paper reconstituted products made therefrom.

Various other features of the present invention will become obvious to one skilled in the art upon reading the novel disclosure set forth herein.

A BRIEF DESCRIPTION OF THE DRAWINGS

Referring to the drawings which disclose an advantageous embodiment of the present invention:

FIG. 1 is a schematic flow diagram of an apparatus which can be used in carrying out the inventive process; and FIG. 2 is a schematic flow diagram of an alternate apparatus which can be used in carrying out the inventive process also utilizing ammonia.

DETAILED DESCRIPTION OF THE INVENTION

Figure 1:
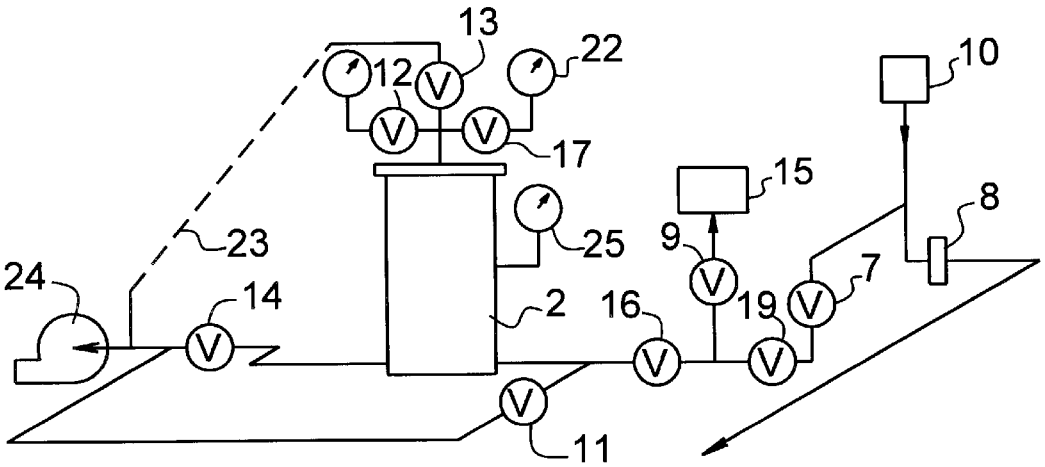

Reference is made to FIG. 1 which shows the preferred embodiment of the inventive process. Tobacco stems to be exploded are deposited into a foraminous screen-type, flow-through basket (not shown). The basket is then placed into a container or impregnator 2 and the lid thereof sealed to prevent leakage. A steam source 10, such as a boiler or any high pressure steam system capable of generating superheated steam at pressures of at least 400 psig and temperatures of 225° C. is provided. A steam trap 8 in the steam addition system is utilized to remove unwanted excess condensate from the steam line so that the condensate does not flow into impregnator 2. A vacuum source 15 is provided to assist in the evacuation of gases following explosion and is controlled by valve 9. Exhaust valves 13 and 14 are specially constructed to allow for sudden and rapid decompression of the steam pressure by rapidly releasing and evacuating the gases contained in the impregnator 2. Exhaust line 23 connects both exhaust valves 13 and 14 to a common exhaust blower 24 which further assists in the decompression and evacuation step.

In operation, primary steam valve 7 is opened to make live steam from steam source 10 available for impregnation of the tobacco in the sealed container. With valves 9, 11, 12, 13, and 14 closed, valves 16 and 17 are opened to introduce steam into the sealed container. The flow of the steam into impregnator 2 is allowed to continue until the desired pressure is in the range of 200 to 400 psig, as indicated by pressure gauge 22, and the desired temperature is brought up to a range of 193° C. to 223° C., as indicated by temperature gauge 25. When the desired pressure and temperature have been reached and the tobacco has been treated for the desired residence time, in the range of 64 to 448 seconds, valve 19 is closed and valves 9, 13 and 14 are opened to immediately evacuate or de-pressurize the impregnator 2. Decompression to ambient takes from about 20 seconds.

During impregnation of the tobacco, steam is forced into the cell walls of the fibers of the tobacco stems. Plant cell walls are made of lignocellulose, which is composed of lignin, a complex polymeric substance, which is combined with cellulose, a fibrous carbohydrate, to thicken and strengthen the cell walls. Upon introduction of superheated steam, the steam reacts with and fragments the biopolymers making up the lignocellulose. Then, upon sudden and rapid decompression of the impregnator 2, some of the cells explode, breaking down the intimate chemical association between the lignin and cellulose. Vacuum valve 9 is opened and the lid to impregnator 2 is removed to let off any remaining gases, and a quenching takes place whereby the material is quickly cooled. The material is then dried for further processing into hand sheets, described above, which are shredded and added to mixtures of tobacco to make reconstituted tobacco product suitable for a smoking article.

Figure 2:
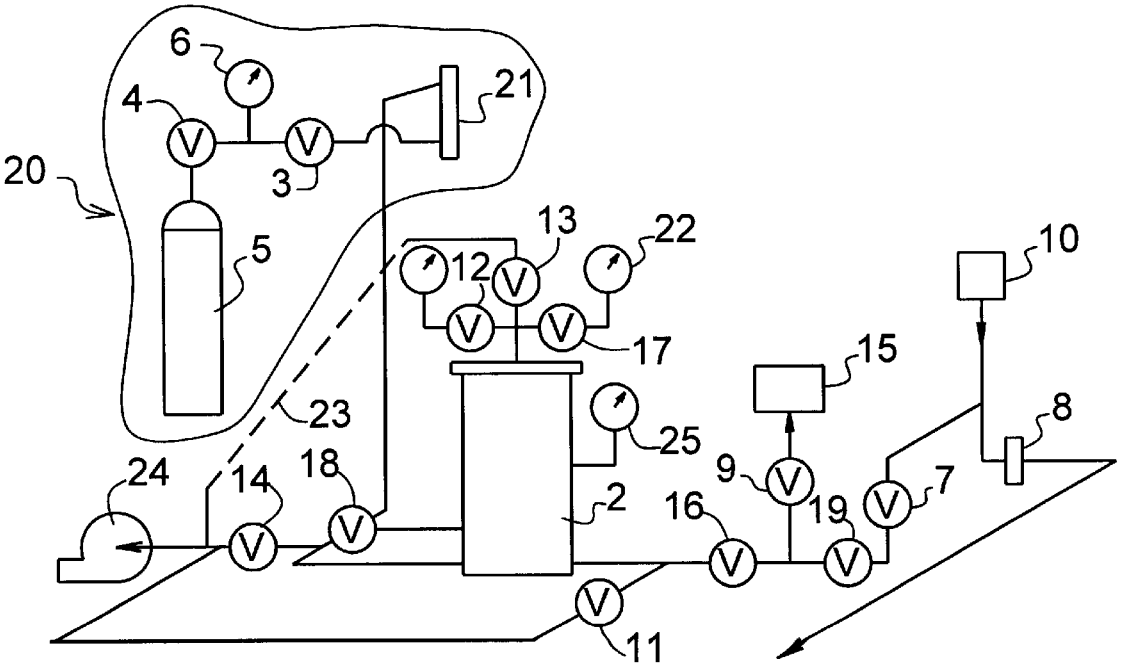

FIG. 2 discloses another preferred embodiment, but with an ammonia delivery system attached which introduces ammonia gas from tank 5 into the atmosphere of impregnator 2, under conditions described above. Tobacco stems are similarly placed in a screen basket (not shown) and inserted into impregnator 2 and the lid thereof sealed to prevent leakage. With valve 3 closed, primary ammonia gas valve 4 is opened. At a pressure of approximately 120 to 130 psig, as shown on pressure gauge 6, ammonia gas is introduced into the containing zone. Primary steam valve 7 is opened to allow superheated live steam from steam source 10, at 200 to 400 psig, to be available for impregnation. With valves 9, 11, 12, 13 and 14 closed, valves 16 and 17 are opened. It is noted that valve 18 serves as a check valve to prevent back flow of gases into ammonia tank 5. Valves 3 and 19 are opened to allow ammonia gas and steam to flow respectively to these valves into impregnator 2, which contains the screen basket of tobacco stems, where the flow of ammonia gas is indicated by rotometer 21. The flow of both gases into impregnator 2 is allowed to continue until the desired pressure is in the range of 200 to 400 psig, as indicated by pressure gauge 22. The temperature of the tobacco is brought to the desired temperature in the range of 193° C. to 223° C., as indicated by temperature gauge 25, and held for a preselected residence time in a range of approximately 1 to 8 minutes. Thereupon, valves 3 and 19 are closed and escape valves 13 and 14 are opened to allow for the rapid and sudden decompression of the impregnator 2, as described above. Also as noted above, line 23 connects both escape valves 13 and 14 to a common exhaust blower 24 which assists in the rapid depressurization step. After depressurization, the tobacco stems are removed and processed for inclusion into smoking articles.

In both of the above preferred embodiments, the tobacco stems to be processed may be pretreated with sugar, diammonium phosphate, or citrus pectin, or other chemical additive, and other chemicals as described above, or any combination thereof, prior to being placed into impregnator 2. Set forth hereinbelow are several examples and resulting tables for processing various tobacco stems in accordance with the inventive process and variations thereof described herein, using either embodiment of the equipment of FIGS. 1 or 2.

EXAMPLE I

A first sample of untreated raw tobacco stems, burley and flue-cured, having a moisture content of approximately 12% by weight, are introduced into the impregnator 2, or reaction vessel, which is then sealed. Saturated steam at temperatures of 215° C. to 223° C. is introduced into the reaction vessel and held for approximately 64 to 448 seconds at a pressure of 200 to 400 psig. The pressure is then suddenly released within 20 seconds to ambient causing the cells to explode and the fibers to separate. The resulting products exhibit sweet aromas reminiscent of chocolate, vanilla, bread, prune, licorice, wine, coffee and pumpkin. In addition, cigarettes incorporating the tobacco product of the first sample has less irritation and more overall taste than cigarettes prepared with the same tobaccos as the example, but excluding reconstituted tobacco made with the Example I.

EXAMPLE II

Two batches of tobacco stems, one of burley and one of flue-cured tobacco, were treated with a 1.25% diammonium phosphate solution. The batches were then steam treated at a temperature range of 193° C. to 223° C. for approximately 3 minutes, then decompressed to ambient pressure within about 20 seconds. The resulting materials varied from fibrous to nearly jelly depending on conditions and they were noted to be more aromatic than raw stems, having aromas described as chocolate, vanilla, licorice, prune, pumpkin, wine, bread, toast and coffee. Subsequent analytical results indicated elevated levels of furan derivatives, carboxylic acid, alcohols and phenolics, in addition to elevated levels of sugars in burley stems.

The steam exploded stems, both burley and flue-cured, were dried at 50° C., cut up and included at 25% by weight levels in a test blend of a cigarette tobacco and smoked by members of a control group. It was found that cigarettes incorporating the tobacco of burley and flue-cured stems, pretreated with diammonium phosphate, were found to have more body, better tobacco taste and less irritation. It was found that flue-cured steam exploded stems, pretreated with ammonium carbonate were preferred, the product showing more impact, irritation and body, and better tobacco taste. It was also found that burley and flue-cured stems, without pretreatment with chemical additives, were preferred over the control sample with more body, better tobacco taste, and equal impact and irritation. Lastly, burley steam exploded stems, pretreated with lactic acid, were preferred over the control sample with better tobacco taste and less impact, irritation, and body.

It is to be understood that various changes can be made by one skilled in the art in one or more of the several steps of the inventive method disclosed herein without departing from the scope or spirit of the present invention.

What is claimed is:

1. A process of exploding tobacco stems to improve smoke quality, comprising the steps of:

depositing said tobacco stems in a sealed container;

treating said tobacco stems with saturated steam at superheated temperatures and high pressures for a time period sufficient for the steam to penetrate the cells of said tobacco stems;

decompressing in less than 20 seconds said sealed container to cause said cells of said tobacco stems to explode; and, removing said exploded tobacco stems from said sealed container.

2. The process of claim 1, wherein said superheated temperatures are approximately 193° C. to 223° C.

3. The process of claim 1, wherein said high pressures are approximately 200 to 400 psig.

4. The process of claim 1, wherein said time periods are approximately 1 to 8 minutes.

5. The process of claim 1, wherein said tobacco stems are pretreated with chemical additives to form favorable flavor compounds.

6. The process of claim 5, wherein said chemical additives are ammonia source materials selected from the group consisting of ammonium bicarbonate, urea, diammonium phosphate, diammonium citrate, gaseous ammonia and combinations thereof.

7. The process of claim 5, wherein said chemical additives are organic acids selected from the group consisting of lactic acid, citric acid, and malic acid.

8. A process of exploding tobacco stems to improve smoke quality and form favorable flavor compounds, comprising the steps of:

treating said tobacco stems with selected chemical additives;

depositing said tobacco stems in a sealed container;

treating said tobacco stems with superheated steam at pressures of 200 to 400 psig for a time period of 1 to 8 minutes;

decompressing to ambient within 20 seconds said saturated steam from said sealed container; and removing said tobacco stems from said sealed container.

9. The process of claim 8, wherein said chemical additives are sources of ammonia.

10. The process of claim 8, wherein said chemical additives are organic acids.

* * * * *